United States Patent [19]

Lee

[11] Patent Number: 4,944,435

[45] Date of Patent: Jul. 31, 1990

[54] DISPOSABLE SEASONING OR CONDIMENT DISPENSER

[76] Inventor: James Lee, 8008 Nagle Ave., N. Hollywood, Calif. 91605

[21] Appl. No.: 348,374

[22] Filed: May 8, 1989

[51] Int. Cl.[5] ..... A47G 19/24

[52] U.S. Cl. ..... 222/565; 229/125.17; 229/5.5

[58] Field of Search ..... 222/565, 480, 142.1, 222/196.1, 547, 548, 555, 561; 229/4.5, 5.5, 5.6, 5.7, 5.8, 125.17

[56] References Cited

U.S. PATENT DOCUMENTS

| | | | |
|---|---|---|---|
| 1,068,446 | 7/1913 | Pullen et al. | 222/565 X |
| 1,086,062 | 2/1914 | Langston | 229/125.17 X |
| 1,758,917 | 5/1930 | Brooks | 229/125.17 X |
| 1,875,412 | 9/1932 | Boiardi | 222/565 |
| 1,876,484 | 9/1932 | Bedworth | 229/5.6 |
| 2,136,795 | 11/1938 | Hoffman | 222/555 X |
| 2,332,768 | 10/1943 | Wilcox | 222/565 |
| 2,359,882 | 10/1944 | Sir | 222/555 X |
| 2,420,738 | 5/1947 | Dickerman | 229/5.5 |
| 2,805,005 | 9/1957 | Kappler | 222/480 |
| 2,832,514 | 4/1958 | O'Connor | 222/480 |
| 3,045,888 | 7/1962 | Forrer | 229/125.17 X |
| 3,258,375 | 6/1966 | Ames | 222/480 X |
| 3,322,318 | 5/1967 | Felton, Jr. et al. | 229/5.5 X |
| 3,346,170 | 10/1967 | Carter | 229/5.5 X |

FOREIGN PATENT DOCUMENTS

| | | | |
|---|---|---|---|
| 220064 | 3/1962 | Austria | 222/480 |
| 2252958 | 6/1975 | France | 222/555 |
| 552173 | 11/1956 | Italy | 222/480 |
| 64059 | 4/1949 | Netherlands | 222/480 |
| 66367 | 6/1943 | Norway | 222/555 |
| 231759 | 4/1925 | United Kingdom | 222/565 |
| 253664 | 6/1926 | United Kingdom | 229/5.7 |
| 574338 | 1/1946 | United Kingdom | 229/4.5 |
| 2075951 | 11/1981 | United Kingdom | 222/565 |

*Primary Examiner*—Kevin P. Shaver
*Attorney, Agent, or Firm*—Erik M. Arnhem

[57] ABSTRACT

A disposable condiment dispenser that comprises an upstanding generally cylindrical tube, preferably formed of cardboard or other analogous material. A perforated disc has a snap-on connection with the upper end of the tube. To refill the dispenser with salt, pepper, etc., the perforated disc is pulled out of the tube.

7 Claims, 1 Drawing Sheet

DISPOSABLE SEASONING OR CONDIMENT DISPENSER

BACKGROUND AND SUMMARY OF THE INVENTION

There is believed to be a need for a low cost disposable seasoning or condiment dispenser, usable e.g. at picnics, at campsites, or at parties, to dispense salt and or pepper.

My invention relates to a low cost condiment dispenser formed preferably out of cardboard using technology already employed in the paper cup industry. My proposed dispenser comprises an upstanding essentially cylindrical tube having an inturned section at its upper end for defining an internal downwardly-facing annular slot. An annular flat disc is arranged within the upper end of the tube, with a peripheral flange of the disc extending upwardly into the annular slot. The upper face of the flat disc forms a seating surface for a second perforated disc that serves as an exit path for salt or pepper when the dispenser is manually overturned.

The tube-disc construction is such that the perforated disc can be manually snapped into place in the upper end of the tube without tools or adhesives; the perforated disc can be similarly snapped out of the tube upper end at any time. This arrangement enables salt or pepper (or other condiment) to be poured into the tube with the perforated disc removed from the tube. Condiment can be added to the tube, as needed. Thus, while the dispenser can be formed as a low cost cardboard assembly, yet the dispenser can be used over and over again.

THE DRAWINGS

DESCRIPTION OF A PREFERRED EMBODIMENT OF THE INVENTION

Figure 3:
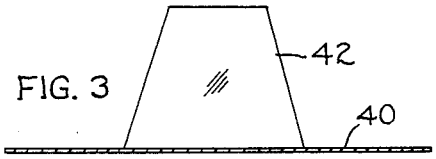
FIG. 3 is a sectional view through a cover for the FIG. 1 dispenser
Figure 1:
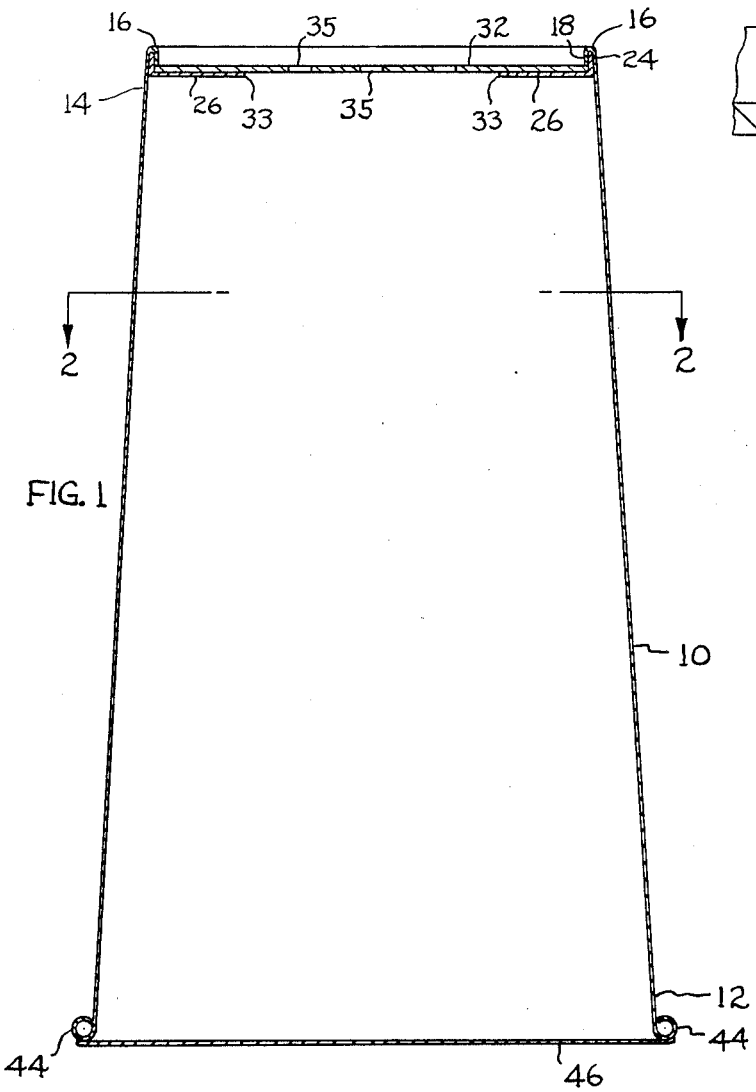
FIG. 1 is a sectional view through a condiment dispenser embodying my invention.

FIG. 1 shows a condiment dispenser that includes an upstanding essentially cylindrical tube 10, preferably formed of cardboard having a wall thickness of about 0.01 inch. The inner and outer surfaces of tube 10 may have very thin plastic films thereon to prevent flow of moisture through the tube wall. Typically tube 10 will have a height of about three inches and a diameter of about one and onehalf inches, although the dispenser tube can of course be formed in a range of sizes.

In order to minimize the possibility of the dispenser tube inadvertently tipping over, it may be tapered radially inwardly to a slight extent from its lower end 12 to its upper end 14. The taper is relatively slight, being on the order of four degrees.

My invention is concerned primarily with the construction at the upper end of tube 10, whereby a perforated top wall is releasably attached to the tube with a unique snap-fit connection. As shown best in FIG. 4, the tube upper end includes a radially inturned annular section 16, followed by an axially reversed downturned section 18 spaced radially inwardly from tube inner surface 20. An annular internal slot 22 is thereby formed in the upper end of the tube.

Slot 22 receives therein an upstanding flange 24 formed on the periphery of an annular flat cardboard disc 26; an adhesive is used to permanently secure flange 24 in slot 22. The axial length of flange 24 is such that when the flange is inserted fully into slot 22 a clearance space is formed between upper face 28 of the disc and the lower edge 29 of downturned section 18 of the tube. Disc 26 forms a seating surface for a second perforated disc 32, which is also preferably formed of cardboard.

It will be seen from FIG. 1 that disc 26 is an annular disc that has a relatively large central opening 33 formed therethrough. With the second perforated disc 32 removed from the dispenser, salt, pepper or other condiment can be poured into tube 10 through central opening 33. After the tube has been charged with condiment, disc 32 can be snapped into place (as shown in FIG. 4), such that perforations 35 in the disc serve as dispenser openings.

Disc 32 is installed onto the upper face 28 of disc 26 merely by pushing disc 32 straight down onto disc 28. Disc 32 will bow slightly to enable its peripheral edge to move downwardly along the exposed surface of reversely turned section 18. When disc 32 reaches the upper face of disc 26 the peripheral edge of disc 32 will snap into the clearance space formed below edge 29 of wall 18. Disc 32 may be removed from its installed position by exerting a pull-up force along the central axis of disc 32 so as to form a reverse bow in the disc. A fork or other implement (not shown) may be hooked into one of the perforations 35 to produce the pull-up force.

Figure 4:
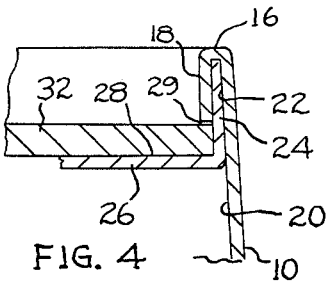
FIG. 4 is an enlarged fragmentary sectional view of a structural detail used in the FIG. 1 dispenser.
Figure 2:
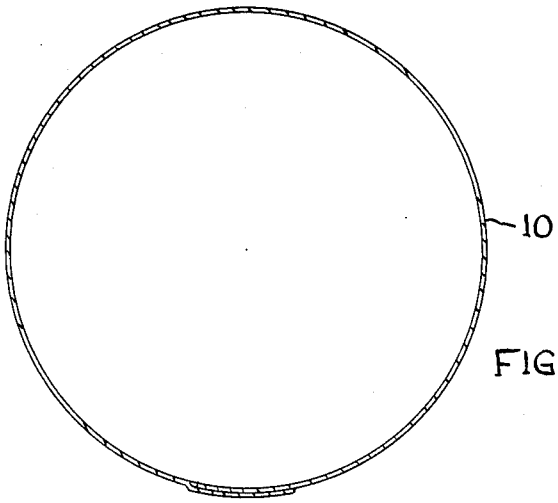
FIG. 2 is a sectional view on line 2—2 in FIG. 1.

As shown in FIG. 4, cardboard disc 32 has a thickness greater than disc 26. Typically, disc 26 will be about 0.01 inch thick, whereas disc 32 will be about 0.02 or 0.025 inch thick. Disc 32 is a thicker multi-ply structure in order that it can adequately withstand the installation and removal forces.

A disc-type cover 40 may be removably positioned on the upper face of perforated disc 32 to prevent dirt from passing into the dispenser through perforations 35 and/or to prevent the escape of condiment out of the dispenser when the dispenser is overturned, e.g. during transit in a picnic basket. An upstanding tab 42 extends from the periphery of cover disc 40 to facilitate manual pull-out of the disc from an operative position engaged against the upper face of disc 32. Cover disc 40 has a diameter slightly greater than the diameter of the space circumscribed by wall 18, so that disc 40 can have its peripheral edge frictionally engaged with the wall 18 surface. The dispenser can be overturned without dislodging disc 40 from the dispenser.

The lower end 12 of tube 10 can be formed with a curled flange 44 that closes against the tube outer surface so as to form a circularly cross-sectioned reinforcement wall structure for the tube. Curled flange 44 is an endless flange extending entirely around the tube 10 circumference.

The bottom wall of the dispense is formed by a flat circular cardboard plate 46 having a diameter slightly less than the outer diameter of curled flange 44. Plate 46 is adhesively secured to (against) the lower surface of flange 44 to form a sealed joint. Plate 46 can be a single ply cardboard element having a thickness on the order of 0.01 inch.

The illustrated dispenser is a relatively low cost disposable device that may be economically formed out of cardboard. Perforated disc 32 can be snapped in place or removed from the dispenser, as necessary for the dispensing function or as required to refill the dispenser.

The drawings show one form that the invention can take. Some structural variations may be resorted to while still practicing the invention.

I claim:

1. A condiment dispenser comprising:

an upstanding essentially cylindrical cardboard tube having a lower end and an upper end;

the upper end of said tube having a radially inturned section, followed by an axially reversed section spaced radially inwardly from the tube inner surface to form an internal annular slot;

a first annular flat disc having a peripheral flange extending into said slot so that an edge of the flange contacts the radially inturned section and the upper disc face is spaced below the lower edge of said axially reversed section;

and a second flat perforated disc seated against the upper face of said annular disc with its peripheral edge extending into the space below the lower edge of the axially reversed section.

2. The condiment dispenser of claim 1, wherein the peripheral flange on the first disc has an axial dimension slightly greater than the axial depth of the annular slot plus the thickness of the second disc.

3. The condiment dispenser of claim 2, wherein the space between the lower edge of said axially reversed section and the upper face of the first disc defines a clearance space; said clearance space being sufficient to permit said second disc to be manually snapped into position after said first disc has been installed in the upstanding tube.

4. The condiment dispenser of claim 1 wherein said first disc has its peripheral flange adhesively secured within the annular slot; said second disc having a snap fit connection with the lower edge of the axially reversed section, such that said second disc can be removed from the upstanding tube.

5. The condiment dispenser of claim 1, wherein the first disc has a thickness of about 0.01 inch, and the second disc has a thickness of about 0.02 inch.

6. The condiment dispenser of claim 5, wherein both discs are cardboard.

7. The condiment dispenser of claim 1, wherein said cylindrical tube is tapered inwardly from its lower end to its upper end; the taper being approximately four degrees.

* * * * *